US009799297B2

(12) United States Patent
Wu et al.

(10) Patent No.: US 9,799,297 B2
(45) Date of Patent: Oct. 24, 2017

(54) DISPLAY PANEL AND DRIVING METHOD FOR THE SAME

(71) Applicant: Shenzhen China Star Optoelectronics Technology Co., Ltd., Shenzhen, Guangdong (CN)

(72) Inventors: Jingjing Wu, Guangdong (CN); Dongsheng Guo, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 128 days.

(21) Appl. No.: 14/765,805

(22) PCT Filed: Jun. 30, 2015

(86) PCT No.: PCT/CN2015/082822
§ 371 (c)(1),
(2) Date: Aug. 4, 2015

(87) PCT Pub. No.: WO2016/201728
PCT Pub. Date: Dec. 22, 2016

(65) Prior Publication Data

US 2016/0372072 A1 Dec. 22, 2016

(30) Foreign Application Priority Data

Jun. 17, 2015 (CN) ..... 2015 1 0338854

(51) Int. Cl.
*G09G 3/36* (2006.01)

(52) U.S. Cl.
CPC ..... *G09G 3/3688* (2013.01); *G09G 3/3648* (2013.01); *G09G 2320/0247* (2013.01); *G09G 2330/026* (2013.01)

(58) Field of Classification Search
CPC ..... G09G 3/3688; G09G 2330/026; G09G 2320/0247
See application file for complete search history.

(56) References Cited

U.S. PATENT DOCUMENTS

2002/0075218 A1 6/2002 Makishima et al.
2004/0095306 A1 5/2004 Fujiyoshi
2004/0145583 A1* 7/2004 Morita ..... G09G 3/3688 345/211

(Continued)

FOREIGN PATENT DOCUMENTS

CN 1588529 A 3/2005
CN 101193193 A 6/2008

(Continued)

*Primary Examiner* — Aneeta Yodichkas
(74) *Attorney, Agent, or Firm* — Andrew C. Cheng

(57) ABSTRACT

A driving method for a display panel is disclosed. The method comprises: when the display panel is under a power-on initialization stage, controlling the pixel unit and the data driver to be disconnected, and after the display panel finishes the power-on initialization stage, controlling the pixel unit and the data driver to be connected such that the data driver provides the data signal to drive the display panel. A display panel is also disclosed. Through above way, the preset invention can avoid a flicker phenomenon generated at a power-on moment of the display panel.

11 Claims, 4 Drawing Sheets

(56) References Cited

U.S. PATENT DOCUMENTS

| | | | | |
|---|---|---|---|---|
| 2006/0279504 | A1* | 12/2006 | Fujita | G09G 3/3614 345/98 |
| 2008/0001876 | A1* | 1/2008 | Ito | G09G 3/3655 345/87 |
| 2012/0326619 | A1 | 12/2012 | Meng | |
| 2014/0104148 | A1* | 4/2014 | Wang | G09G 5/00 345/92 |
| 2014/0184482 | A1 | 7/2014 | Zhang | |
| 2014/0191931 | A1 | 7/2014 | Kim | |

FOREIGN PATENT DOCUMENTS

| | | | |
|---|---|---|---|
| CN | 101211036 | A | 7/2008 |
| CN | 101252659 | A | 8/2008 |
| CN | 101369403 | A | 2/2009 |
| CN | 101373302 | A | 2/2009 |
| CN | 102708784 | A | 10/2012 |
| CN | 104112438 | A | 10/2014 |

* cited by examiner

DISPLAY PANEL AND DRIVING METHOD FOR THE SAME

BACKGROUND OF THE INVENTION

1. Field of the Invention

The present invention relates to a liquid crystal technology field, and more particular to a display panel and a driving method for the same.

2. Description of Related Art

In a driving process for a conventional display panel and in a normal power-on timing diagram of the display panel, before turning on a power source of a common electrode trace VCOM, a data driver turns on a closed-terminal voltage VGL (a source voltage) of a thin film transistor (TFT). That is, at a time t2, the data driver turns on the closed-terminal voltage VGL first, then, at a time t3, the data driver turns on the power source of the common electrode trace VCOM (as shown in FIG. 2). In above situation, the display panel is displayed normally.

If a time sequence between the closed-terminal voltage VGL of the thin film transistor and the power source of the common electrode trace VCOM in an instant time that powering on the display panel is wrong, the closed-terminal voltage VGL of the thin film transistor is turned on after turning on the power source of the common electrode trace VCOM (as shown in FIG. 3). That is, within a time period Td between T2-T3, the closed-terminal voltage VGL of the thin film transistor is zero voltage, but the common electrode voltage VCOM is already reached a normal voltage level. According to a conduction property of a thin film transistor, a zero voltage can make the thin film transistor to be in a slightly conductive status, a zero voltage provided by the data driver can transmit to pixel electrode terminal vs through the thin film transistor to charge liquid crystal capacitors (Cst and Clc) such that a voltage difference is generated between the pixel electrode vs and the common electrode trace VCOM. Accordingly, a voltage difference is generated between two terminals of liquid crystal molecules to tilt the liquid crystal molecules. A backlight source will generate a white picture so that a flicker phenomenon when powering on the display panel will be generated.

In summary, a display panel and a driving method for the same are required to solve the above problems.

SUMMARY OF THE INVENTION

The main technology solved by the present invention is to provide a display panel and a driving method in order to solve a flicker problem when power-on a display panel because of wrong power timing sequence.

In order to solve the above technology problem, a technology solution adopted by the present invention is: a display panel, comprising: an array substrate, including a pixel unit, a data line, a scanning line and a common electrode trace, wherein, the pixel unit is respectively connected with the data line, the scanning line and the common electrode trace; a data driver, connected with the pixel unit through the data line, and used for providing a data signal to the pixel unit; and a control switch, used for controlling a connection between the pixel unit and the data driver; wherein, when a display panel is under a power-on initialization stage, the control switch controls the pixel unit and the data driver to be disconnected; after the display panel finishes the power-on initialization stage, the control switch controls the pixel unit and the data driver to be connected such that the data driver provides the data signal to drive the display panel; wherein, when the display panel is under the power-on initialization stage, the control switch controls the data line to be connected with the common electrode trace such that the pixel unit and the data driver are disconnected; and wherein, after the display panel finishes the power-on initialization stage, the control switch controls the data line to be connected with the data driver such that the pixel unit and the data driver are connected.

Wherein, the pixel unit includes a pixel electrode, a switching unit and a discharge capacitor; a first terminal of the switching unit is connected with the scanning line, a second terminal of the switching unit is connected with the data line; a third terminal of the switching unit is connected with the pixel electrode; the discharge capacitor and the pixel electrode are connected in parallel; the control switch includes a first endpoint, a second endpoint and a third endpoint; the first endpoint is connected with the data line, the second endpoint is connected with the common electrode trace, and the third endpoint is connected with the data driver; wherein, when the display panel is under the power-on initialization stage, the control switch controls the first endpoint to be connected with the second endpoint such that the data line is connected with the common electrode trace.

Wherein, the pixel unit includes a pixel electrode, a switching unit and a discharge capacitor; a first terminal of the switching unit is connected with the scanning line, a second terminal of the switching unit is connected with the data line; a third terminal of the switching unit is connected with the pixel electrode; the discharge capacitor and the pixel electrode are connected in parallel; the control switch includes a first endpoint, a second endpoint and a third endpoint; the first endpoint is connected with the data line, the second endpoint is connected with the common electrode trace, and the third endpoint is connected with the data driver; wherein, after the display panel finishes the power-on initialization stage, the control switch controls the first endpoint to be connected with the third endpoint such that the data line and the data driver are connected.

Wherein, the switching unit is a thin film transistor; a first terminal of the switching unit is a gate of the thin film transistor; a second terminal of the switching unit is a source of the thin film transistor; a third terminal of the switching unit is a drain of the thin film transistor.

Wherein, the switching unit is a darlington transistor; a first terminal of the switching unit is a base of the darlington transistor; a second terminal of the switching unit is a collector of the darlington transistor; a third terminal of the switching unit is an emitter of the darlington transistor.

Wherein, the switching unit is a triode; a first terminal of the switching unit is a base of the triode; a second terminal of the switching unit is a collector of the triode; a third terminal of the switching unit is an emitter of the triode.

In order to solve the above problems, another technology solution adopted by the present invention is: an array substrate, including a pixel unit, a data line, a scanning line and a common electrode trace, wherein, the pixel unit is respectively connected with the data line, the scanning line and the common electrode trace; a data driver, connected with the pixel unit through the data line, and used for providing a data signal to the pixel unit; and a control switch, used for controlling a connection between the pixel unit and the data driver; wherein, when a display panel is under a power-on initialization stage, the control switch controls the pixel unit and the data driver to be disconnected; after the display panel finishes the power-on initialization stage, the control switch controls the pixel unit and the data driver to be connected such that the data driver provides the data signal to drive the display panel.

Wherein, when the display panel is under the power-on initialization stage, the control switch controls the data line to be connected with the common electrode trace such that the pixel unit and the data driver are disconnected.

Wherein, the pixel unit includes a pixel electrode, a switching unit and a discharge capacitor; a first terminal of the switching unit is connected with the scanning line, a second terminal of the switching unit is connected with the data line; a third terminal of the switching unit is connected with the pixel electrode; the discharge capacitor and the pixel electrode are connected in parallel; the control switch includes a first endpoint, a second endpoint and a third endpoint; the first endpoint is connected with the data line, the second endpoint is connected with the common electrode trace, and the third endpoint is connected with the data driver; wherein, when the display panel is under the power-on initialization stage, the control switch controls the first endpoint to be connected with the second endpoint such that the data line is connected with the common electrode trace.

Wherein, after the display panel finishes the power-on initialization stage, the control switch controls the data line to be connected with the data driver such that the pixel unit and the data driver are connected.

Wherein, the pixel unit includes a pixel electrode, a switching unit and a discharge capacitor; a first terminal of the switching unit is connected with the scanning line, a second terminal of the switching unit is connected with the data line; a third terminal of the switching unit is connected with the pixel electrode; the discharge capacitor and the pixel electrode are connected in parallel; the control switch includes a first endpoint, a second endpoint and a third endpoint; the first endpoint is connected with the data line, the second endpoint is connected with the common electrode trace, and the third endpoint is connected with the data driver; wherein, after the display panel finishes the power-on initialization stage, the control switch controls the first endpoint to be connected with the third endpoint such that the data line and the data driver are connected.

Wherein, the switching unit is a thin film transistor; a first terminal of the switching unit is a gate of the thin film transistor; a second terminal of the switching unit is a source of the thin film transistor; a third terminal of the switching unit is a drain of the thin film transistor.

Wherein, the switching unit is a darlington transistor; a first terminal of the switching unit is a base of the darlington transistor; a second terminal of the switching unit is a collector of the darlington transistor; a third terminal of the switching unit is an emitter of the darlington transistor.

Wherein, the switching unit is a triode; a first terminal of the switching unit is a base of the triode; a second terminal of the switching unit is a collector of the triode; a third terminal of the switching unit is an emitter of the triode.

In order to solve the above problems, another technology solution adopted by the present invention is: a driving method for a display panel, wherein, the display panel includes an array substrate and a data driver; the array substrate includes a pixel unit, a data line, a scanning line and a common electrode trace; the pixel unit is respectively connected with the data line, the scanning line and the common electrode trace; the driving method comprising following steps: when the display panel is under a power-on initialization stage, controlling the pixel unit and the data driver to be disconnected; and after the display panel finishes the power-on initialization stage, controlling the pixel unit and the data driver to be connected such that the data driver provides the data signal to drive the display panel.

Wherein, in a step of when the display panel is under a power-on initialization stage, controlling the pixel unit and the data driver to be disconnected comprises: when the display panel is under the power-on initialization stage, controlling the data line to be connected with the common electrode trace such that the pixel unit and the data driver are disconnected.

Wherein, the pixel unit includes a pixel electrode, a switching unit and a discharge capacitor; a first terminal of the switching unit is connected with the scanning line, a second terminal of the switching unit is connected with the data line; a third terminal of the switching unit is connected with the pixel electrode; the discharge capacitor and the pixel electrode are connected in parallel; the control switch includes a first endpoint, a second endpoint and a third endpoint; the first endpoint is connected with the data line, the second endpoint is connected with the common electrode trace, and the third endpoint is connected with the data driver; wherein, in a step of when the display panel is under the power-on initialization stage, controlling the data line to be connected with the common electrode trace comprises: when the display panel is under the power-on initialization stage, controlling the first endpoint to be connected with the second endpoint such that the data line and the common electrode trace are connected.

Wherein, in a step of after the display panel finishes the power-on initialization stage, controlling the pixel unit and the data driver to be connected comprises: after the display panel finishes the power-on initialization stage, controlling the data line to be connected with the data driver such that the pixel unit and the data driver are connected.

Wherein, the pixel unit includes a pixel electrode, a switching unit and a discharge capacitor; a first terminal of the switching unit is connected with the scanning line, a second terminal of the switching unit is connected with the data line; a third terminal of the switching unit is connected with the pixel electrode; the discharge capacitor and the pixel electrode are connected in parallel; the control switch includes a first endpoint, a second endpoint and a third endpoint; the first endpoint is connected with the data line, the second endpoint is connected with the common electrode trace, and the third endpoint is connected with the data driver; wherein, in a step of after the display panel finishes the power-on initialization stage, controlling the data line to be connected with the data driver comprises: after the display panel finishes the power-on initialization stage, controlling the first endpoint to be connected with the third endpoint such that the data line and the data driver are connected.

Wherein, the switching unit is a thin film transistor; a first terminal of the switching unit is a gate of the thin film transistor; a second terminal of the switching unit is a source of the thin film transistor; a third terminal of the switching unit is a drain of the thin film transistor.

The beneficial effects of the present invention are: comparing to the conventional art, in the power-on initialization stage of the present invention, the control switch controls the first endpoint to be connected with the second endpoint such that the pixel unit and the data driver are disconnected. After the display panel finishes the power-on initialization stage, the control switch controls the first endpoint to be connected with the third endpoint such that the pixel unit is connected with the data driver so that the data driver can provide a data signal to the pixel unit in order to drive the display panel. The present invention can disconnect the pixel unit from the data driver at a power-on initialization stage so as to avoid a flicker phenomenon when powering on the display panel.

DETAILED DESCRIPTION OF THE PREFERRED EMBODIMENT

The following content combines figures and embodiments for detail description of the present invention.

Figure 1:
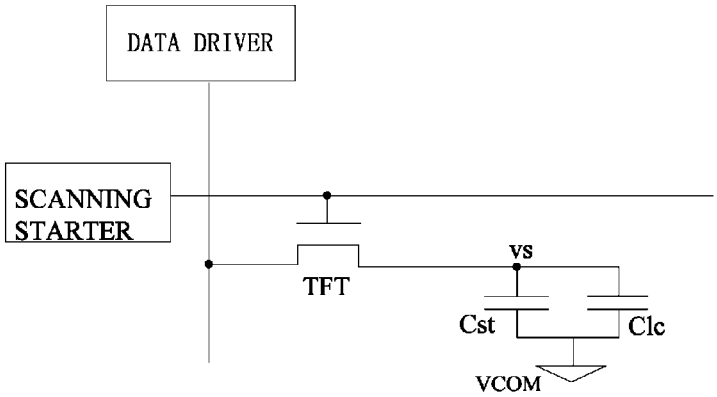
FIG. 1 (Prior Art)
FIG. 1 is a schematic diagram of a pixel unit structure of a display panel according to the conventional art.
Figure 2:
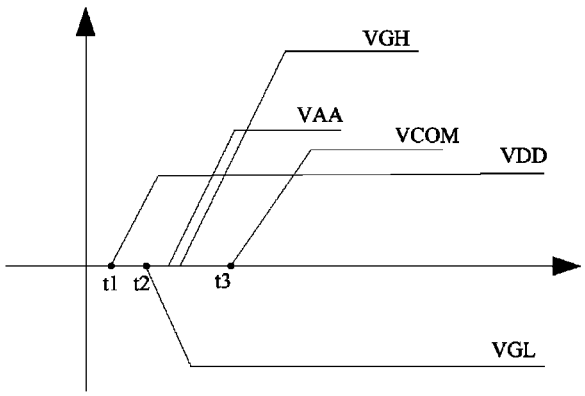
FIG. 2 (Prior Art)
FIG. 2 is a timing diagram of a normal power supply when powering on the display panel according to the conventional art.
Figure 3:
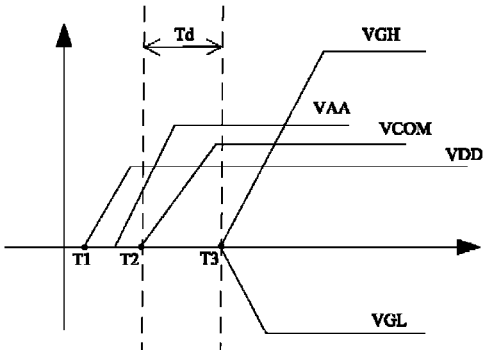
FIG. 3 (PRIOR ART)
FIG. 3 is a timing diagram of an abnormal power supply when powering on the display panel according to the conventional art.
Figure 4:
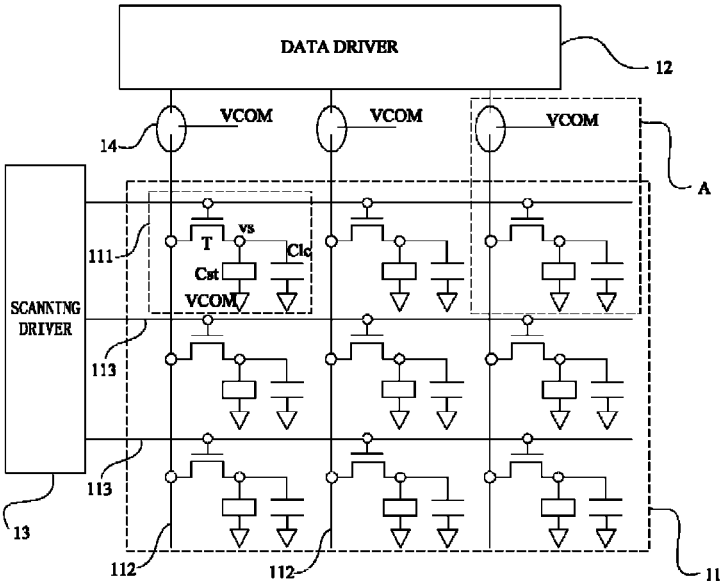
FIG. 4 is a schematic structure diagram of a display panel according to the present invention.
Figure 5:
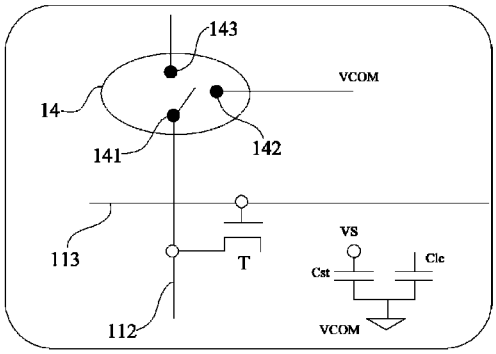
FIG. 5 is a partial enlarged diagram of portion A shown in FIG. 4.

The present invention discloses a display device. The display device includes a display panel. As shown in FIG. 4 and FIG. 5, the display panel includes an array substrate 11, a data driver 12, a scanning driver 13 and a control switch 14. In the present embodiment, the control switch 14 is independently disposed inside the display panel. It can be understood that in another embodiment, the control switch 14 can be disposed inside the data driver 12 so as to become a part of the data driver 12 and control the control switch 14 through the data driver 12. Besides, the control switch 14 can also be disposed in a timing controller (not shown in the figures) so as to control the control switch 14 through a timing controller.

The data driver 12 is used for providing a data signal for an array substrate 11 in order to drive the array substrate 11.

The scanning driver 13 is used for providing a scanning signal for the array substrate 11 in order to execute a signal scanning to the array substrate 11.

The control switch 14 is used for controlling a connection between the array substrate 11 and the data driver 12. Specifically, when turning on the display panel in a power-on initialization stage, the control switch 14 disconnects the data driver 12 from the array substrate 11. After the display panel finishes the power-on initialization stage, the control switch 14 connects the array substrate 11 and the data driver 12 so that the data driver 12 provides a data signal to drive the display panel. It can be understood that in the power-on initialization stage and after the power-on initialization stage, the scanning driver is continuously connected with the array substrate 11.

It can be understood that in another embodiment, to keep synchronization with the data driver 12, in the power-on initialization stage of the display panel, the scanning driver 13 stop sending a scanning signal in order to prevent the array substrate 11 from executing a signal scanning. After the display panel finishes the power-on initialization stage, the scanning driver 13 executes a signal scanning to the array substrate 11.

In the present embodiment, the array substrate 11 includes a pixel unit 111, a data line 112, a scanning line 113 and a common electrode trace VCOM. The pixel unit 111 is respectively connected with the data line 112, the scanning line 113 and the common electrode trace VCOM. The data driver 12 is connected with the pixel unit 111 through the data line 112 in order to provide a data signal for the pixel unit 111. The scanning driver 13 is connected with the pixel unit 111 through the scanning line 113 in order to provide a scanning signal to the pixel unit 111. In a power-on initialization stage of a display panel, the control switch 14 disconnects the data driver 12 from the pixel unit 111. After the display panel finishes the power-on initialization stage, the control switch 14 controlling the data driver 12 to be connected with the pixel unit 111 such that the data driver 12 provides a data signal to the display panel. In another embodiment, In a power-on initialization stage of a display panel, the scanning driver 13 stop sending a scanning signal to prevent the pixel unit 111 from being executing a signal scanning. After the power-on initialization stage is finished, the scanning driver 13 executes a signal scanning to the pixel unit 111.

Preferably, in the power-on initialization stage of the display panel, the control switch 14 connects the data line 112 with the common electrode trace VCOM such that the pixel unit 11 and the data driver 112 are disconnected. After the power-on initialization stage is finished, the control switch 14 controls the data line 112 to be connected with the data driver 12 such that the pixel unit 111 and the data driver 12 are connected.

In the present embodiment, the pixel unit 111 includes a pixel electrode vs, a switching unit T and a discharge capacitor Clc. A first terminal of the switching unit T is connected with the scanning line 113, a second terminal of the switching unit T is connected with the data line 112, a third terminal of the switching unit T is connected with the pixel electrode vs, the discharge capacitor Clc and the pixel electrode vs are connected in parallel. The control switch 14 includes a first endpoint 141, a second endpoint 142 and a third endpoint 143. The first endpoint 141 is connected with a data line 112, a second endpoint 142 is connected with the common electrode trace VCOM, and the third endpoint 143 is connected with the data driver 12.

It can be understood that the control switch 14 of the present invention is not limit to the first endpoint 141, the second endpoint 142 and the third endpoint 143. The requirement is that in the power-on initialization stage, the control switch 14 controls a second terminal of the switching unit T to be connected with the common electrode trace VCOM, and after the display panel finishes the power-on initialization stage, the control switch 14 controls the second endpoint of the switching unit T to be connected with the data driver 12.

In the present embodiment, the switching unit T is a thin film transistor. A first terminal of the switching unit T is a gate of the thin film transistor, a second terminal of the switching unit T is a source of the thin film transistor, and a third terminal of the switching unit T is a drain of the thin film transistor. It can be understood that in another embodiment, the switching unit T can be a darlington transistor or a triode. A first terminal of the switching unit T is a base of a darlington transistor or a triode. A second terminal of the switching unit T is a collector of a darlington transistor or a triode. A third terminal of the switching unit T is an emitter of a darlington transistor or a triode.

In the present embodiment, in the power-on initialization stage, the control switch 14 controls the first endpoint 141 to be connected with the second endpoint 142 such that the data line 112 is connected with the common electrode trace VCOM, and the pixel unit 111 and the data driver 12 are disconnected. At this time, the data driver 12 cannot provide a data signal to the pixel unit 111. When the switching unit T is conductive or slightly conductive, a voltage difference between the pixel electrode vs and the common electrode trace VCOM is zero. After the display panel finishes the power-on initialization stage, the control switch 14 controls the first endpoint 141 to be connected with the third endpoint 143 such that the data line 112 is connected with the data driver 12 so that the pixel unit 111 is connected with the data driver 12. At this time, the data driver 12 can provide a data signal to the pixel unit 111 in order to drive the display panel.

The following will combine the embodiment to illustrate the operation principle of the display panel.

Figure 6:
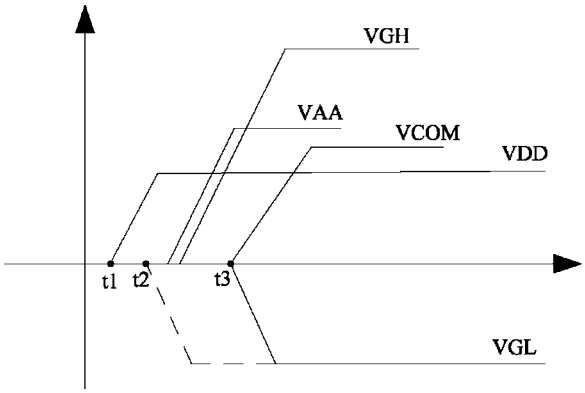
FIG. 6 is a timing diagram of power supply when powering on the display panel according to the present invention.

As shown in FIG. 6, in a power-on initialization stage (t2-t3) of a display panel, the control switch 14 controls the first endpoint 141 and the second endpoint 142 to be connected, the data line 112 and the common electrode trace VCOM are connected, the pixel unit 111 and the data driver 12 are disconnected. At this time, a voltage of a second terminal of the switching unit T and a voltage of the common electrode trace VCOM are the same.

During the power-on initialization stage (t2-t3), when the switching unit T is slightly conductive, the voltage of the second terminal of the switching unit T is the voltage of the common electrode trace VCOM. The second terminal of the switching unit T charges the liquid crystal capacitor Cst. Finally, a voltage of the pixel electrode vs is the voltage of the common electrode trace VCOM. A voltage difference between the pixel electrode vs and the common electrode trace VCOM is zero so that the liquid crystal molecules are not tilted in order to display a black picture.

After finishing the power-on initialization stage at t3 moment, that is, each power and each data are ready. For example, a power source VDD is ready for normally providing power to the display panel and a module power source VAA is ready for providing power to modules such as an A/D converter or a timing controller. The control switch 14 controls the first endpoint 141 and the third endpoint 143 to be connected, the data line 112 and the data driver 12 to be connected, the pixel unit 111 and the data driver 12 to be connected. The voltage of the common electrode trace VCOM and the closed-terminal voltage VGL of the switching unit T are started synchronously, and the data driver 12 provides a data signal to the pixel unit 111 in order to drive the display panel.

Figure 7:
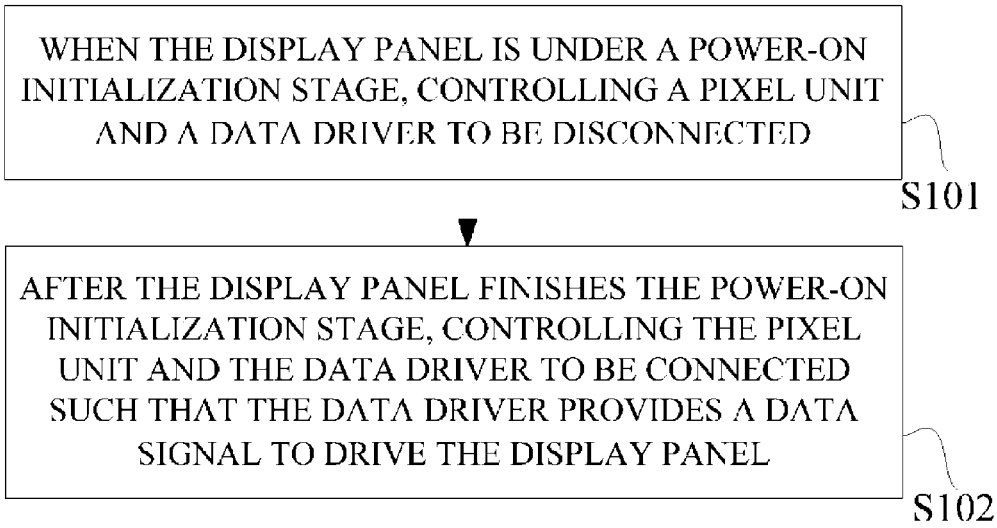
FIG. 7 is a flow chart of a driving method for a display panel of the present invention.

As shown in FIG. 7, FIG. 7 is a flow chart of a driving method for a display panel of the present invention. The method shown in FIG. 7 corresponds to the display panel shown in FIG. 4. The method includes flowing steps:

Step S101: when the display panel is under a power-on initialization stage, controlling a pixel unit 111 and a data driver 12 to be disconnected.

In the present embodiment, when the display panel is under a power-on initialization stage, controlling the data line 112 and the common electrode trace VCOM to be connected such that the pixel unit 111 and the data driver 12 are disconnected. Preferably, when the display panel is under the power-on initialization stage, controlling a first endpoint 141 of a control switch 14 to be connected with a second endpoint 142 of the control switch 14 such that the data line 112 and the common electrode trace VCOM are connected, and the pixel unit 111 and the data driver 12 are disconnected.

Step S102: after the display panel finishes the power-on initialization stage, controlling the pixel unit 111 and the data driver 12 to be connected such that the data driver 12 provides a data signal to drive the display panel.

In the present embodiment, after the display panel finishes the power-on initialization stage, controlling the data line 112 and the data driver 12 to be connected such that the pixel unit 111 and data driver 12 are connected. Preferably, after the display panel finishes the power-on initialization stage, controlling the first endpoint 141 of the control switch 14 and the third endpoint 143 of the control switch 14 to be connected such that the data line 112 and the data driver 12 are connected, and the pixel unit 111 and the data driver 12 are connected. The data driver 12 outputs a data signal to drive the display panel.

It can be understood that in another embodiment, to keep synchronization with the data driver 12, in the power-on initialization stage of the display panel, the scanning driver 13 stop sending a scanning signal in order to prevent the pixel unit 111 from executing a signal scanning. After the power-on initialization is finish, the scanning driver 13 executes a signal scanning to the pixel unit 111.

In summary, in the power-on initialization stage of the present invention, the control switch controls the first endpoint to be connected with the second endpoint such that the pixel unit and the data driver are disconnected. After the display panel finishes the power-on initialization stage, the control switch controls the first endpoint to be connected with the third endpoint such that the pixel unit is connected with the data driver so that the data driver can provide a data signal to the pixel unit in order to drive the display panel. The present invention can disconnect the pixel unit from the data driver at a power-on initialization stage so as to avoid a flicker phenomenon when powering on the display panel.

The above embodiments of the present invention are not used to limit the claims of this invention. Any use of the content in the specification or in the drawings of the present invention which produces equivalent structures or equivalent processes, or directly or indirectly used in other related technical fields is still covered by the claims in the present invention.

What is claimed is:

1. A display panel, comprising:

an array substrate, including a pixel unit, a data line, a scanning line and a common electrode trace, wherein, the pixel unit is respectively connected with the data line, the scanning line and the common electrode trace;

a data driver, connected with the pixel unit through the data line, and used for providing a data signal to the pixel unit; and a control switch, used for controlling a connection between the pixel unit and the data driver;

wherein, when a display panel is under a power-on initialization stage, the control switch controls the pixel unit and the data driver to be disconnected, and the scanning driver stops sending a scanning signal to the pixel unit in order to prevent the pixel unit from executing a signal scanning; after the display panel finishes the power-on initialization stage, the control switch controls the pixel unit and the data driver to be connected such that the data driver provides the data signal to drive the display panel;

wherein, when the display panel is under the power-on initialization stage, the control switch controls the data line to be directly connected with the common electrode trace such that the pixel unit and the data driver are disconnected, and a voltage on the common electrode trace is zero during the power-on initialization stage; and wherein, after the display panel finishes the power-on initialization stage, the control switch controls the data line to be connected with the data driver such that the pixel unit and the data driver are connected.

2. The display panel according to claim 1, wherein, the pixel unit includes a pixel electrode, a switching unit and a discharge capacitor; a first terminal of the switching unit is connected with the scanning line, a second terminal of the switching unit is connected with the data line; a third terminal of the switching unit is connected with the pixel electrode; the discharge capacitor and the pixel electrode are connected in parallel; the control switch includes a first endpoint, a second endpoint and a third endpoint; the first endpoint is connected with the data line, the second endpoint is connected with the common electrode trace, and the third endpoint is connected with the data driver;

wherein, when the display panel is under the power-on initialization stage, the control switch controls the first endpoint to be connected with the second endpoint such that the data line is connected with the common electrode trace.

3. The display panel according to claim 2, wherein, the switching unit is a thin film transistor; a first terminal of the switching unit is a gate of the thin film transistor; a second terminal of the switching unit is a source of the thin film transistor; a third terminal of the switching unit is a drain of the thin film transistor.

4. The display panel according to claim 2, wherein, the switching unit is a Darlington transistor; a first terminal of the switching unit is a base of the Darlington transistor; a second terminal of the switching unit is a collector of the Darlington transistor; a third terminal of the switching unit is an emitter of the Darlington transistor.

5. The display panel according to claim 2, wherein, the switching unit is a triode; a first terminal of the switching unit is a base of the triode; a second terminal of the switching unit is a collector of the triode; a third terminal of the switching unit is an emitter of the triode.

6. The display panel according to claim 1, wherein, the pixel unit includes a pixel electrode, a switching unit and a discharge capacitor; a first terminal of the switching unit is connected with the scanning line, a second terminal of the switching unit is connected with the data line; a third terminal of the switching unit is connected with the pixel electrode; the discharge capacitor and the pixel electrode are connected in parallel; the control switch includes a first endpoint, a second endpoint and a third endpoint; the first endpoint is connected with the data line, the second endpoint is connected with the common electrode trace, and the third endpoint is connected with the data driver;

wherein, after the display panel finishes the power-on initialization stage, the control switch controls the first endpoint to be connected with the third endpoint such that the data line and the data driver are connected.

7. A driving method for a display panel, wherein, the display panel includes an array substrate and a data driver; the array substrate includes a pixel unit, a data line, a scanning line and a common electrode trace; the pixel unit is respectively connected with the data line, the scanning line and the common electrode trace; the driving method comprising following steps:

when the display panel is under a power-on initialization stage, controlling the pixel unit and the data driver to be disconnected, and controlling the data line to be directly connected with the common electrode trace such that the pixel unit and the data driver are disconnected, wherein a voltage on the common electrode trace is zero during the power-on initialization stage, and the scanning driver stops sending a scanning signal to the pixel unit in order to prevent the pixel unit from executing a signal scanning; and after the display panel finishes the power-on initialization stage, controlling the pixel unit and the data driver to be connected such that the data driver provides the data signal to drive the display panel.

8. The driving method according to claim 7, wherein, the pixel unit includes a pixel electrode, a switching unit and a discharge capacitor; a first terminal of the switching unit is connected with the scanning line, a second terminal of the switching unit is connected with the data line; a third terminal of the switching unit is connected with the pixel electrode; the discharge capacitor and the pixel electrode are connected in parallel; the control switch includes a first endpoint, a second endpoint and a third endpoint; the first endpoint is connected with the data line, the second endpoint is connected with the common electrode trace, and the third endpoint is connected with the data driver;

wherein, in a step of when the display panel is under the power-on initialization stage, controlling the data line to be connected with the common electrode trace comprises:

when the display panel is under the power-on initialization stage, controlling the first endpoint to be connected with the second endpoint such that the data line and the common electrode trace are connected.

9. The driving method according to claim 8, wherein, the switching unit is a thin film transistor; a first terminal of the switching unit is a gate of the thin film transistor; a second terminal of the switching unit is a source of the thin film transistor; a third terminal of the switching unit is a drain of the thin film transistor.

10. The driving method according to claim 7, wherein, in a step of after the display panel finishes the power-on initialization stage, controlling the pixel unit and the data driver to be connected comprises:

after the display panel finishes the power-on initialization stage, controlling the data line to be connected with the data driver such that the pixel unit and the data driver are connected.

11. The driving method according to claim 10, wherein, the pixel unit includes a pixel electrode, a switching unit and a discharge capacitor; a first terminal of the switching unit is connected with the scanning line, a second terminal of the switching unit is connected with the data line; a third terminal of the switching unit is connected with the pixel electrode; the discharge capacitor and the pixel electrode are connected in parallel; the control switch includes a first endpoint, a second endpoint and a third endpoint; the first endpoint is connected with the data line, the second endpoint is connected with the common electrode trace, and the third endpoint is connected with the data driver;

wherein, in a step of after the display panel finishes the power-on initialization stage, controlling the data line to be connected with the data driver comprises:

after the display panel finishes the power-on initialization stage, controlling the first endpoint to be connected with the third endpoint such that the data line and the data driver are connected.

* * * * *